United States Patent [19]

Grebel et al.

[11] Patent Number: 4,604,956

[45] Date of Patent: Aug. 12, 1986

[54] ADJUSTMENT MECHANISM FOR WORK STATION

[75] Inventors: Robert E. Grebel, Northboro; Robert K. Neunherz, Westminster; David W. McGrath, Rochdale, all of Mass.

[73] Assignee: Wright Line Inc., Worcester, Mass.

[21] Appl. No.: 612,002

[22] Filed: May 18, 1984

[51] Int. Cl.[4] ..... F16H 25/20; A47B 9/12

[52] U.S. Cl. ..... 108/147; 74/89.15; 74/424.8 R

[58] Field of Search ..... 108/3, 5, 7, 147, 106, 108/146, 144, 9, 10; 248/405, 406.1, 406.2, 422, 188.2, 188.4; 74/89.15, 424.8; 312/312, 231

[56] References Cited

U.S. PATENT DOCUMENTS

| | | | |
|---|---|---|---|
| 981,113 | 1/1911 | Richards | 108/147 |
| 2,991,030 | 7/1961 | Herbolsheimer | 108/147 X |
| 3,385,238 | 5/1968 | Jay | 108/147 |
| 3,587,482 | 6/1971 | Wieland | 108/147 |
| 3,606,801 | 9/1971 | Williams | 74/424.8 R |
| 3,745,840 | 7/1973 | Guralnick | 74/89.15 |
| 4,018,217 | 4/1977 | Evans | 248/405 X |

FOREIGN PATENT DOCUMENTS

| | | | |
|---|---|---|---|
| 1192492 | 5/1965 | Fed. Rep. of Germany R | 74/424.8 |
| 2078902 | 1/1982 | United Kingdom | 74/89.15 |
| 48007 | 7/1980 | U.S.S.R. | 74/89.15 |

*Primary Examiner*—William E. Lyddane
*Assistant Examiner*—Peter A. Aschenbrenner
*Attorney, Agent, or Firm*—Schiller & Pandiscio

[57] ABSTRACT

An adjustable height table comprising a telescoping table support assembly including stationary and movable posts interconnected in telescoping relationship to one another and positionable by a drive screw and a captive nut. The screw is mounted for rotation about its own axis, and is secured against translation along its axis, relative to one of the posts (preferably, the fixed post) such that its axis of rotation is roughly parallel the direction of the telescoping motion between the two posts. The nut is secured against rotation as the screw is rotated. The nut is provided with a female connection dimensioned to loosely captivate a pin secured to the other post (e.g., in the preferred embodiment, the movable post) so as to be roughly normal to the axis of rotation of the screw. Preferably, the bearing surface between the nut and the pin is minimized and restricted to a region of the nut proximate the surface of the screw.

10 Claims, 6 Drawing Figures

ADJUSTMENT MECHANISM FOR WORK STATION

BACKGROUND OF THE INVENTION

This invention relates to mechanisms for providing adjustment of a work station, and more particularly to such mechanisms employing one or more lead screws and associated captive nuts to allow the displacement of one portion of the work station relative to another portion of the work station.

Adjustable work stations that are adaptable to variations in the sizes of various users are well known. Typical of such devices are drafting tables, easels, and the like. More recently, the wide-spread application of small computers and word processors has seen the introduction of computer work stations having independent adjustable supports for keyboard and display.

Many mechanisms have been used to permit the adjustment of the height of a work surface while still insuring the stability of the surface against loads. This latter requirement has frequently resulted in work stations which may be adjusted only with considerable effort, and then often only by discrete (and frequently less than optimal) amounts.

A solution which has been previously employed to permit continuous adjustment over a range of heights makes use of lead screws to provide the necessary mechanical advantage and ease of adjustment between elements of a structure. A screw having a length greater than the desired excursion is positioned on one element of the structure, with the screw's axis of rotation parallel to the desired direction of adjustment. A mating nut is affixed to the other element of the structure. Relative rotation of the nut and screw produces a relative linear displacement of the two elements. The present invention is directed toward such mechanisms.

A problem encountered with prior art devices incorporating such lead screws and captive nuts is the tendency of such mechanisms to bind unless they are made and assembled with careful attention to the dimensional tolerances and alignment of the various parts. Thus, the axes of the screw and of the structures constraining the travel of the moving component must generally be accurately parallel. In the event the motion is provided by a pair of parallel screws, they, too, must generally be accurately parallel. Such requirements for accurate parallelism impose critical limitations on component tolerances. This results in both greater manufacturing costs and higher maintenance requirements.

The effects of misalignment are further compounded by any eccentric loading of the nut. Any couple produced as a result of applying forces off the axis of the nut will tend to produce a binding torque. It will be appreciated that other design considerations (e.g., style, size, and the like) may preclude applying a balanced load to the nut.

Accordingly, it is an object of the present invention to provide a simple, easily fabricated adjustment means for adjustable work stations.

It is also an object of the present invention to provide a screw-driven adjustable work station which is relatively free of critical parts tolerances and assembly steps, yet is also relatively immune to binding during relative motion of the parts.

Yet another object of the present invention is to provide such an adjustment means which is easily maintained.

Still another object of the invention is to provide an adjustment mechanism comprising a lead screw and captive nut wherein the mechanism is relatively free of the deleterious effects of eccentric loading.

BRIEF DESCRIPTION OF THE INVENTION

These and other objects are met in the present invention of an adjustable work station in the form of an adjustable height table comprising a telescoping table support assembly including stationary and movable posts interconnected in telescoping relationship to one another and positionable by a lead screw and a captive nut. The screw is mounted for rotation about its own axis, and is secured against translation along its axis, relative to one of the posts (preferably, the fixed post) such that its axis of rotation is roughly parallel to the direction of the telescoping motion between the two posts. The nut is secured against rotation as the screw is rotated. The nut is provided with a female connection dimensioned to loosely captivate a pin secured to the other post (e.g., in the preferred embodiment, the movable post) so as to be roughly normal to the axis of rotation of the screw. Preferably, the bearing surface between the nut and the pin is minimized and restricted to a region of the nut proximate the surface of the screw.

The restriction of the rotation of the nut causes the nut to translate parallel to the axis of the screw as the screw is rotated. In turn, motion of the nut produces motion of the captivated pin and the attached post. The loose fitting which characterizes the connection between the nut and the pin accommodates and compensates for any misalignment of the components. The disposition of the area of contact between the pin and the nut near the surface of the screw minimizes the couple about the surface of the nut.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

BRIEF DESCRIPTION OF THE DRAWINGS

For a fuller understanding of the nature and objects of the present invention, reference should be had to the following detailed description taken in connection with the accompanying drawings wherein.

In the various views, like index numbers indicate similar elements.

DETAILED DESCRIPTION

Figure 1:
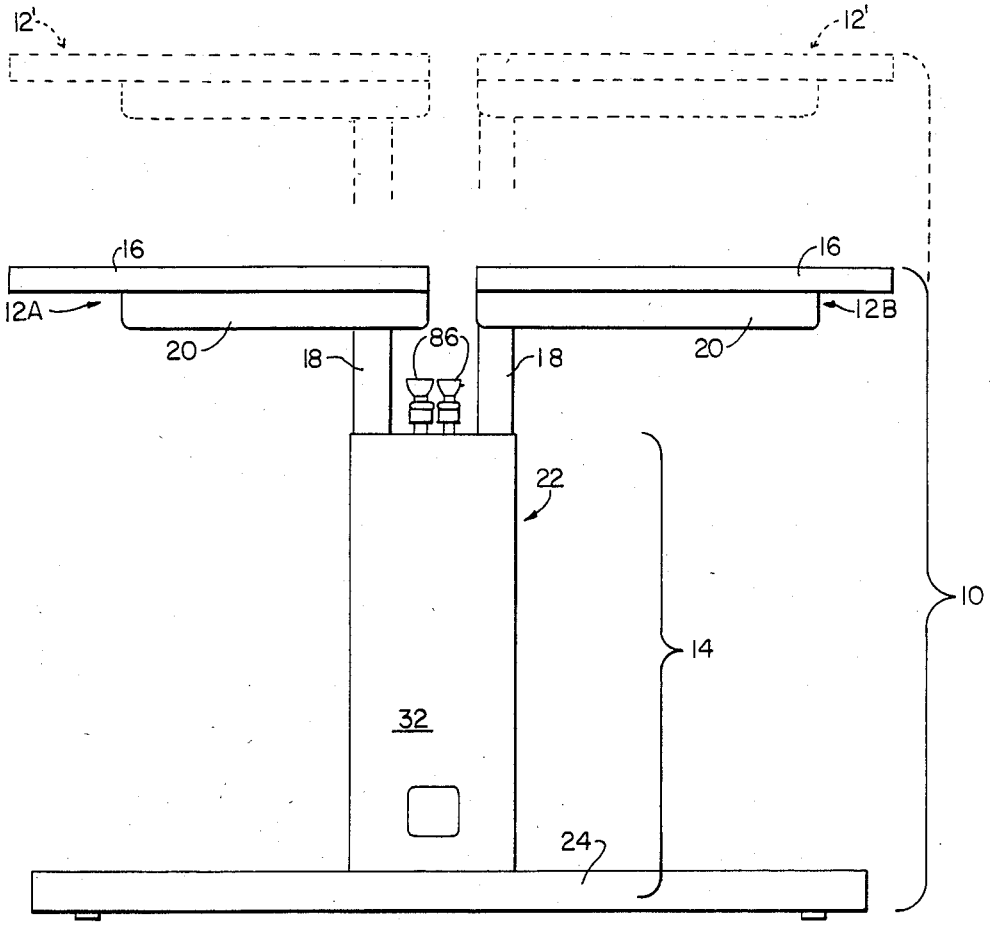
FIG. 1 is an end view of a work station in the form of a pair of adjustable height tables incorporating the preferred embodiment of the present invention.

Referring firstly to FIG. 1, there may be seen a side elevation of work station 10 incorporating the preferred embodiment of the present invention. Work station 10 is in the form of a pair of independently adjustable front and rear tables, indicated in general by numerals 12A and 12B respectively. Tables 12A and 12B share a common support 14. Each table 12 further comprises a top 16 secured to a pair of movable posts 18 by appropriate cantilevers 20. As will be described in greater detail hereinafter, movable posts 18 are supported in telescoping relationship to common support 14 such that each table 12 may be independently adjusted between a lower position (as shown by solid lines in FIG. 1) and an upper position (12', shown in phantom in FIG. 1).

Figure 2:
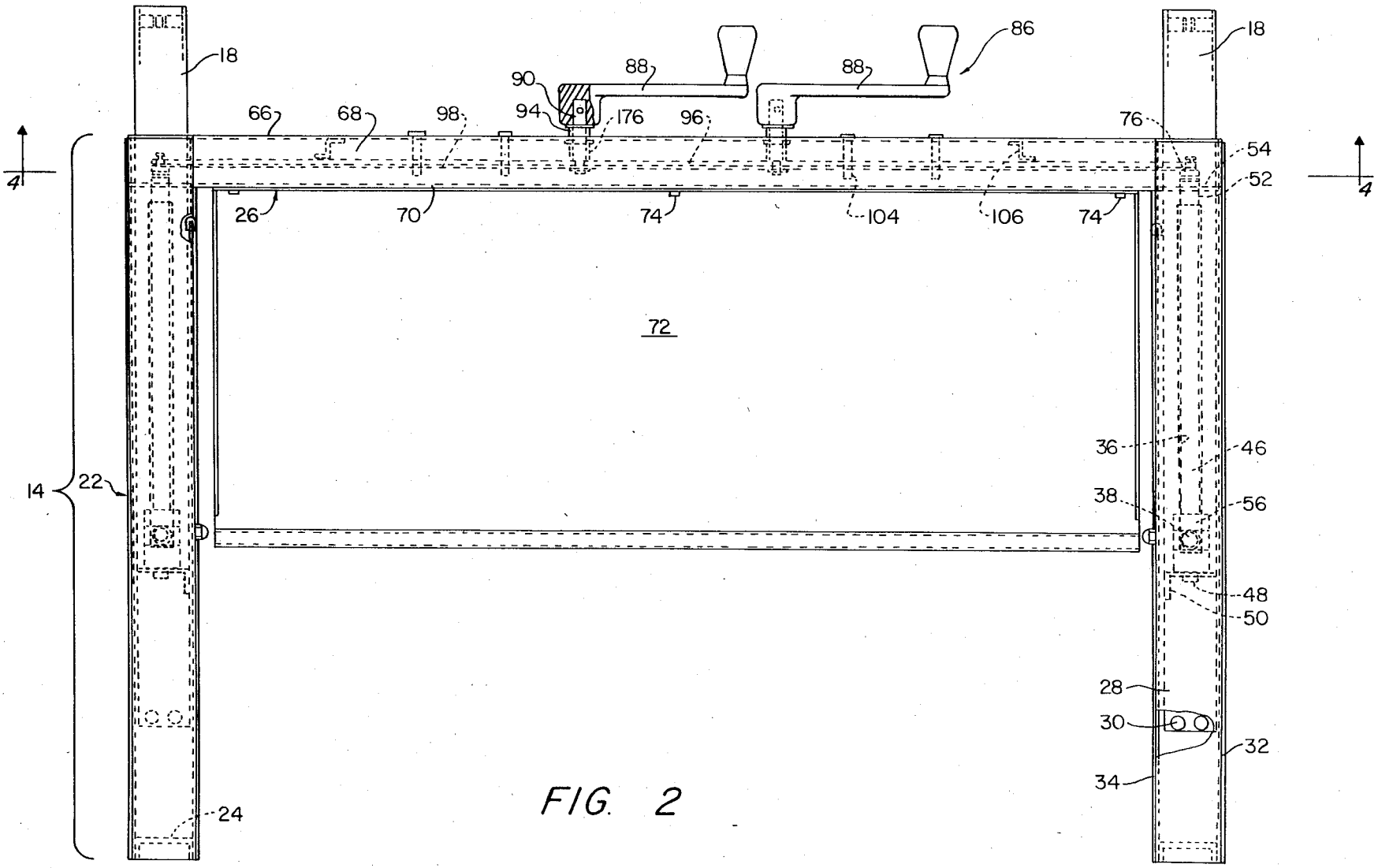
FIG. 2 is a front view of the lower portion of the work station of FIG. 1 partially broken away to show internal detail and further showing in phantom view a portion of the internal mechanism.

Common support 14 comprises a pair of pedestals 22, each provided with a base 24, joined together by strut 26 (FIG. 2). As may be seen by reference to FIGS. 2 and 4, each pedestal 22 is of hollow, rectangular box-like construction. In greater detail, each pedestal 22 incorporates a pair of hollow fixed posts 28. Posts 28 are held in parallel, spaced-apart relationship by outer and inner end panels 32 and 34 respectively. In turn, the pair of posts 28 in part form a frame securing inner and outer end panels 32 and 34 in parallel, spaced apart relationship. Exterior surfaces of posts 28 and end panels 32 and 34 form the exterior vertical surfaces of pedestals 22. The lower portion of each pedestal 22 is closed off by base 24, aligned normal to and extending between and beyond posts 28. The upper end of pedestals 22 are closed off, between posts 28, by a portion of strut 26.

The interior of each fixed post 28 is configured and dimensioned to accept and support, in telescoping relationship, a movable post 18. Preferably, but not necessarily, movable posts 18 and fixed posts 28 are of rectangular cross section. However, it will be understood that the posts may be of circular, polygonal, or other cross section. While fixed posts 28 must necessarily be hollow to accommodate movable posts 18, the latter, although preferably hollow, may, if desired, be solid. It will be understood by those skilled in the mechanical arts that the lengths of fixed and movable posts 28 and 18 respectively must exceed the desired range of adjustment of the associated table 12 (i.e., the distance between 12 and 12' in FIG. 1) by a sufficient margin to insure the continued engagement of the posts and the stability of the table throughout the range of adjustment. It will also be understood that the upper end of fixed posts 28 and the lower end of movable posts 18 may be provided with bearing surfaces, as bushings 30 shown on posts 18 in FIG. 2, in order to minimize sliding friction between the posts.

The inward facing portion of each fixed post 28 (i.e., the portion facing the attached post 28 across the interior of pedestal 22) is provided with an elongate slot 36 running lengthwise along the post (FIG. 2). The lengths of each slot 36 are chosen to exceed the desired range of adjustment of the associated table 12 by at least the width of each slot. The width of each slot 36 is made to exceed the outside diameter of a flange 42 on a coupling 38, as will be described, and yet also be substantially narrower than the width of a movable post 18. In the preferred embodiment, slots 36 are displaced from the upper end of pedestals 22 by a distance slightly exceeding the height of strut 26. Slots 36 are aligned substantially parallel to the longitudinal axes of their respective posts and to one another, so as to extend parallel to and midway between end panels 32 and 34.

Figure 3:
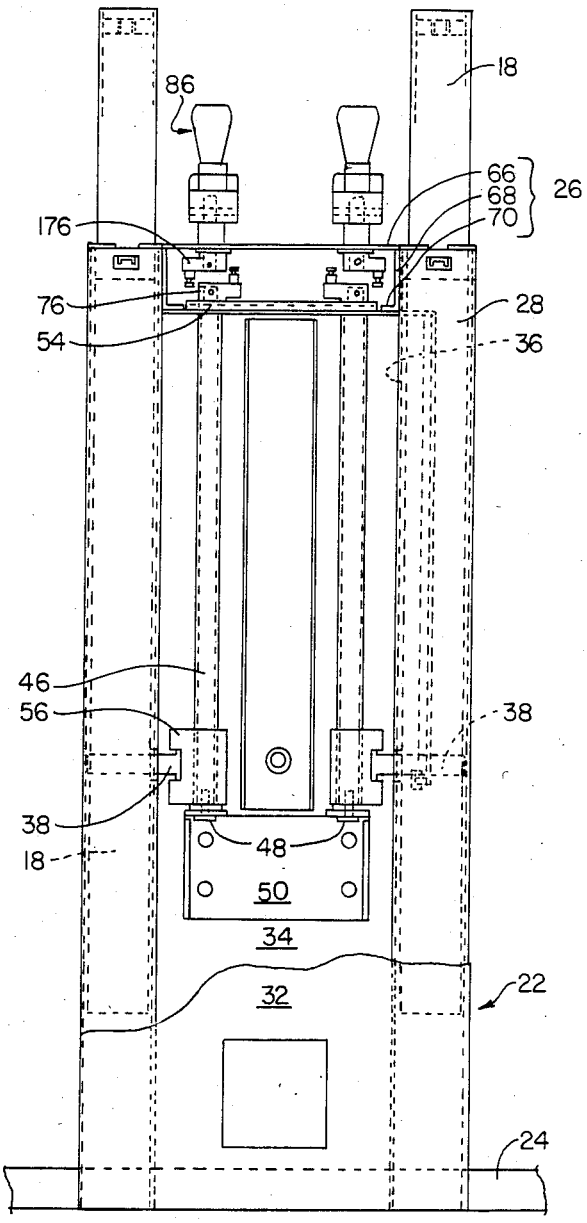
FIG. 3 is an end view of the lower portion of the work station of FIG. 1, partially broken away to expose internal detail.
Figure 5:
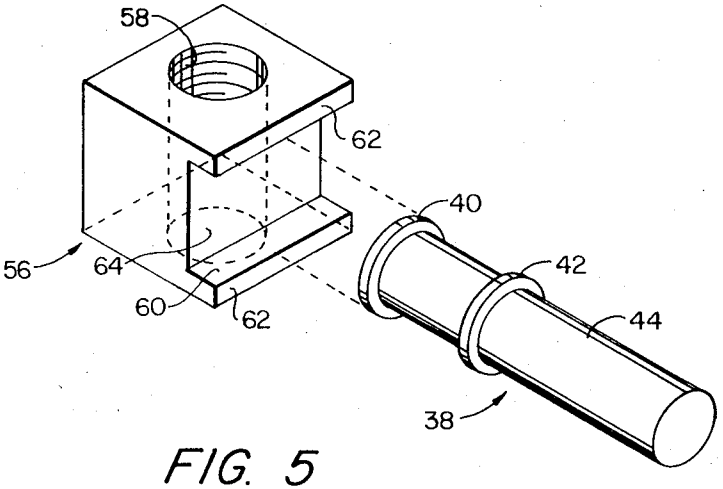
FIG. 5 is a detailed elevation of a nut and pin constituting a component of the preferred embodiment.

Each movable post 18 is provided with a coupling 38, which may best be seen in FIG. 5. Coupling 38 is preferably in the form of a roughly cylindrical pin having a concentrically flanged head 40 at one end and a concentric flange 42 displaced from the other end by a distance substantially equal to the thickness of post 18. The axial extent of a flange 42 is preferably on the order of the thickness of the wall of fixed post 28. The diameter of each coupling 38 is selected on the basis of the load to be supported and its material of construction, and, as will be apparent, must not exceed the thickness of a movable post 18. Referring to FIGS. 2 and 3, it may be seen that couplings 38 are secured to posts 18, as by forced fit of the shank portions 44 into bores (for reasons of clarity, not indexed) passing through the posts, so as to extend substantially normal to the longitudinal axes of the posts. For such assembly, flange 42 serves as a stop to limit the penetration of shank portion 44 to the thickness of post 18. In the preferred embodiment, wherein posts 18 (and 28) are of rectangular cross section, couplings 38 are so attached to bores disposed substantially normal to a pair of faces, and midway between the adjoining faces. The bores are disposed longitudinally along the posts so as to be opposite slots 36 throughout the desired range of motion of the respective table 12. Couplings 38 are attached to movable posts 18 so as to extend through slots 36 of fixed posts 28, with heads 40 extending into the interior of pedestals 22. It will be appreciated from the foregoing description that flanges 42 fall within slots 36.

Situated within each pedestal 22, between and substantially parallel to fixed posts 28 and in confronting relationship to the opposing slot 36, are a pair of screws 46, as may be best seen in FIG. 3. Each screw 46 is supported by a lower bearing 48, preferably in the form of a pin, secured to an in panel 32 by a mounting bracket 50. The upper end of each screw 46 passes through a journal 52 in plate 54 affixed near the upper end of the pedestal. The lengths of screws 46 are selected to exceed the total adjustment desired by at least the axial dimension of a nut 56, as may be deduced from the following discussion. The diameter and pitch of screws 46 are selected on the basis of the load to be supported and the ease of adjustment, as will be understood by those skilled in the art. Screws 46 are spaced from posts 28 by a distance greater than at least the sum of the thickness of waist 64 of nut 56, to now be described, and the distance the adjacent head 40 of coupling 38 extends beyond slot 36. The excess spacing between screws 46 and posts 28 over the just noted dimensions of nut and coupling are chosen to accommodate the maximum anticipated maufacturing and assembly errors of posts, screw, nut, and coupling.

Captively engaged to each screw 46 is a nut 56. As may best be seen by reference to FIG. 5, nut 56 preferably is of the general form of a rectangular solid, having a threaded bore 58 passing normally through a pair of opposite faces. Threaded bore 58 is dimensioned and configured to engage the threads of screw 46. A rectangular kerf or slot 60 is cut into one of the faces not pentrated by bore 58 so as to form a pair of rectangular lips 62 separated by a waist 64 of rectangular form orthonormal (i.e, orthogonal and normal) to the end faces penetrated by bore 58. Kerf 60 is set into nut 56 so that waist 64 approaches the outer diameter of threaded bore 58 as closely as mechanical considerations, having due regard for the loads to be supported and the nut's material of construction, will permit. Lips 62 are spaced apart by a distance substantially equal to the outer diameter of a flanged head 40 of a coupling 38, and are dimensioned to support the load to be accommodated by the associated table 12. Lips 62 are made to extend from waist 64 no further than the separation between head 40 and flange 42 of coupling 38, so as to ride well clear of post 28 when the nut is assembled on screw 46 with lips 62 facing the adjacent post. Nut 56 is further dimensioned to extend from screw 46 by distances less than the separation between the screw and end panels 32 and 34 of pedestal 22, the nut for this purpose being aligned on the screw such that waist 64 is directed toward the adjacent post 28. However, in this regard it will be understood that screws 46 and nuts 56 provide support for the load carried by their associated table, and that for certain circumstances the dimensions of the pedestal might need be modified to accommodate the mechanism.

Strut 26 is preferably of open construction, in the form of an inverted channel, and is affixed to the upper ends of pedestals 22, extending substantially perpendicularly between them, and extending on each pedestal from the vicinity of plate 54 to the top of the pedestal.

Figure 4:
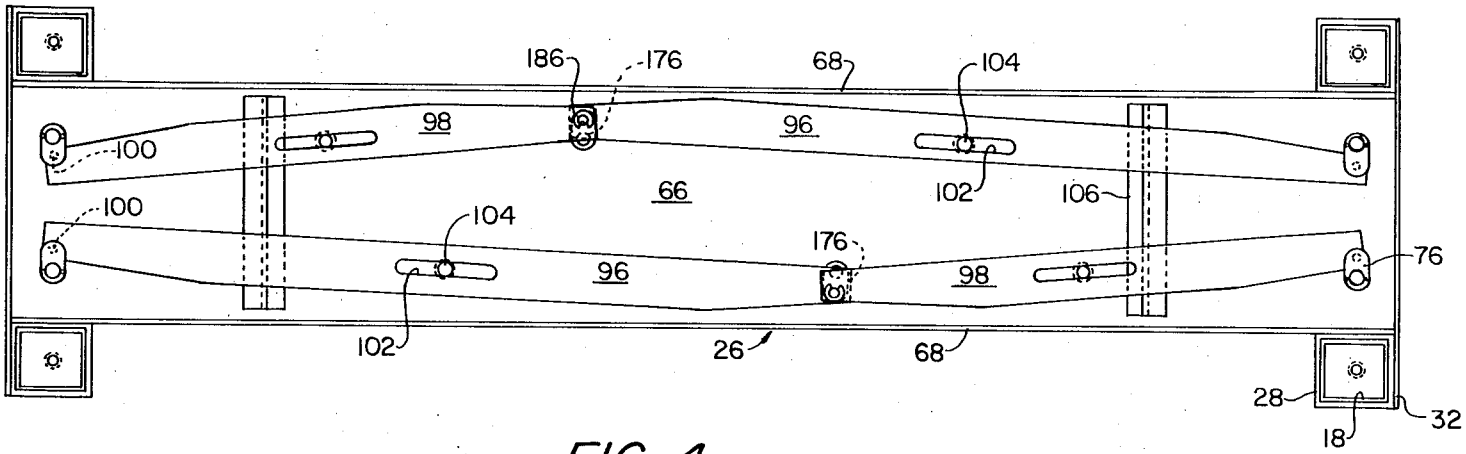
FIG. 4 is a sectional view taken along the line 4—4 of FIG. 2.

In greater detail, strut 26 is preferably fabricated of a single piece of sheet metal folded into a channel-shaped form having a top 66 and sides 68 (FIGS. 2–4). Top 66 is of rectangular form, having a width substantially equal to the separation between posts 28 of a pedestal 22 and a length substantially equal to the overall separation of the pedestals. Sides 68 are of similar length, and have a height comparable to the separation between plates 54 and the upper ends of the pedestals 22. The lower edges of sides 68 are preferably each provided with a reentrant lip 70 (FIGS. 2 and 3). Reentrant lips 70 serve to reinforce sides 68 of strut 26, and may also serve to hold modesty panel 72, as by attachments 74, if desired.

Beyond structurally supporting pedestals 22 in spaced apart relationship, strut 26 is intended, in the preferred embodiment, as a housing for the mechanism operating screws 46.

Figure 6:
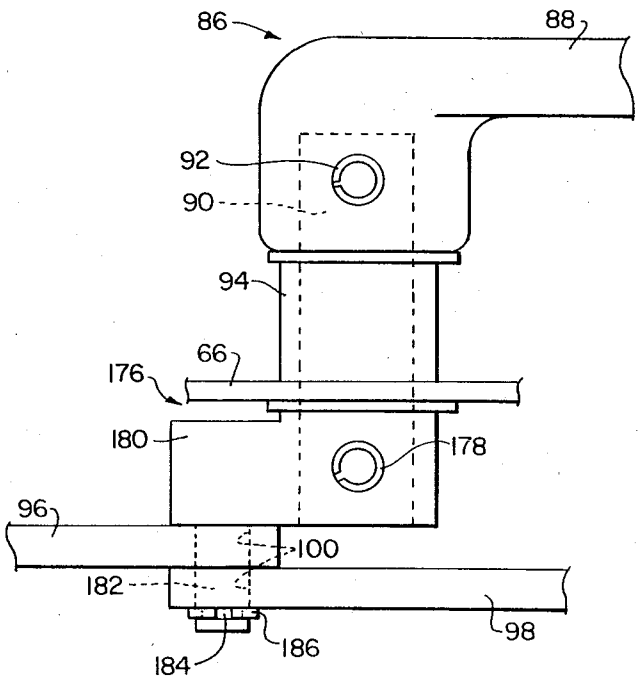
FIG. 6 is a fragmentary detail of the crank and arm linkage of the preferred embodiment.
Figure 6:
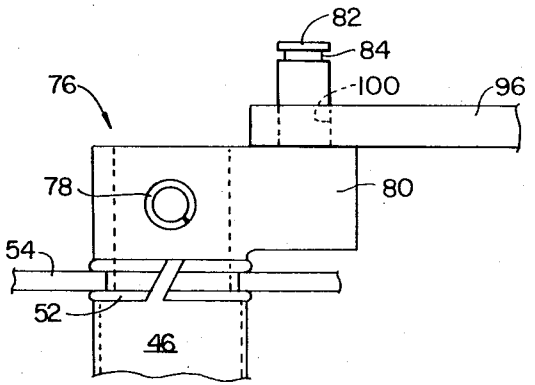

Mounted at the top end of each screw 46, and above the respective journal 52, is an eccentric 76, shown in detail in FIG. 6. Eccentrics 76 are collars dimensioned to fit over the end of a screw 46, and are affixed to the end of the screw as by split pin 78. Each eccentric 76 has an eccentric arm 80 extending substantially normal to the axis of screw 46, at the end of which is a swivel post 82, affixed substantially parallel to the axis of rotation of the screw. Swivel posts 82 are preferably of right circular cylindrical form. The end of each post 82 distal arm 80 is provided with a circumferential groove 84. Groove 84 is spaced from arm 80 by a distance slightly greater than twice the thickness of a rod 96 or 98, as will be described hereinafter.

Located near the center of strut 26 in the preferred embodiment are a pair of manual cranks 86. Each crank 86 comprises a handle 88 affixed to a cylindrical spindle 90, as by a slotted tubular pin 92, although it will be understood that spindles 90 could be provided with a keyed end and handles 86 could be provided with an appropriately configured socket. Spindles 90 are rotatably mounted to top 66 of strut 26 by journals 94, such that the axes of rotation of the spindles are substantially normal to the top surface of top 66. Journals 94 are located at substantially equal distances from the midpoint of strut 26, their separation being dictated by the requirement that handles 88 of cranks 86 clear one another. It will be appreciated that, for a sufficiently wide strut 26, and particularly for the case of removable handles 88, journals 94 could be positioned on the line equidistant from the ends of the strut. Spindles 90 pass through journals 94 and penetrate into the interior of strut 26, between sides 68.

Mounted at the lower end of each spindle 90, and below top 66, and the respective journal 94, is an eccentric 176, shown in detail in FIG. 6. Eccentrics 176 are collars dimensioned to fit over the end of a spindle 90, and are affixed to the end of the spindle as by a roll pin 178. Each eccentric 176 has an eccentric arm 180 extending substantially normal to the axis of spindle 90, at the end of which is a swivel post 182, affixed substantially parallel to the axis of rotation of the screw. Swivel posts 182 are preferably of right circular cylindrical form. The end of each post 182 is provided with a circumferential groove 184 situated at a distance from arm 180 slightly in excess of twice the thickness of a rod 96 (or 98), to be described hereinafter. Eccentric 176 is dimensioned so that the separation between the axes of spindle 90 and swivel post 182 is substantially equal to the separation between the axes of screw 46 and post 82 of eccentric 76. Indeed, it will be understood that eccentrics 176 and 76 are preferably identical units, elements 76 through 84 corresponding to elements 176 through 184.

In the preferred embodiment, screws 46 are connected in pairs to cranks 86, the front screws of each pedestal (i.e., the screws supporting table 12 A of FIG. 1) being connected to the front crank, and the rear screws (those supporting table 12B), to the rear crank. The linkage is made between the respective eccentrics 76 and 176 by connecting rods 96 and 98. Connecting rods 96 and 98 are in the form of elongate flat straps, each end of which is provided with a circular aperture 100 dimensioned to fit a post 82 (or 182). The distance between apertures 100 on a given rod 96 (or 98) is selected to be substantially equal to the distance between the axes of rotation of the respective spindle 90 and screw 46. In the preferred embodiment, rods 96 and 98 are of differing lengths, to accommodate the uncentered location, relative to pedestals 22, of cranks 86. However, it will be appreciated that cranks 86 might both be situated equidistant from the ends of strut 26, in which event rods 96 and 98 would be of similar lengths. Situated about the midpoint of each rod 96 and 98 is a slot 102 positioned along the line joining the apertures 100 at the ends of the rod. Each slot 102 is of roughly rectangular form, and is provided with a length exceeding its width by a distance at least twice the distance separating the axis of a screw 46 from the respective post 82 on the respective eccentric 76.

Strut 26 is also provided with a plurality of pins 104, of right circular cylindrical form, attached to the inside of the strut midway between the axes of the respective spindles 90 and screws 46. Pins 104 are attached to the underside of top 66 so as to be substantially normal to the surface of the top. Each pin 104 is provided with a diameter substantially equal to the width of a slot 102.

Rods 96 and 98 are positioned between respective cranks and screws with apertures 100 engaging posts 82 and 182 of eccentrics 76 and 176, and with slots 102 engaging the respective pins 104. For rods 96 and 98 of unequal length, it is preferable that the longer rod be the upper rod of the pair of rods extending to the opposite pedestals. The rods are secured to posts 182 by split rings 186 engaged in grooves 184. The other end of the rods need not necessarily be so secured to posts 82 in the preferred embodiment, the rods being held captive on the posts by gravity.

Depending on the span of strut 26, it may be desirable to provided reinforcing, as by reinforcements 106 extending transversely across the underside of top 66, as will be understood by those skilled in the art.

Considering now the operation of adjustable work station 10, it will be understood that rotation of a crank 86 produces rotation of the attached eccentric 76. The associated rods 96 and 98 are restricted to reciprocate about pins 104, the reciprocal motion being communicated to the attached eccentrics 76. Eccentrics 76 are thereby rotated by the associated crank 86, in turn rotating the attached lead screws 46. Both of the lead screws 46 associated with a given table 12A or 12B are thereby operated in synchronization. The associated captivated nuts 56 are free to rotate until the engagement of waists 64 with the respective head 40 of coupling 38. Thereafter, nuts 56 are displaced axially along screws 46 as the latter are rotated.

As a nut 56 is thus displaced, so to is the engaged head 40 of coupling 38. Lips 62 and waist 64 in effect form a female socket for coupling 38. The disposition of waist 64, as near bore 58 as the structural integrity of nut 56 permits, situates the bearing point between nut and coupling as near the axis of the bore as possible. This minimizes the couple of the force applied by coupling 38 about the center of nut 56. As a result, the tendency of any forces applied to the nut by coupling 38 to bind the nut to screw 46 are also minimized.

Additionally, while head 40 of the coupling is restricted in its motion parallel to the axis of screw 46 by lips 62, it is free to otherwise move relative to nut 56, at least to a restricted extent. The motion of head 40 normal to the nominal plane of the axes of screw 46 and post 18 is parallel to the direction of kerf 60, and absent other restraints coupling 38 is free to move in this direction relative to the nut. Coupling 38 is free to move slightly toward and away from the associated nut 56 by the clearance deliberately left between screw 46 and the adjacent posts 18 and 20, this relative translation of nut and coupling being accommodated by a slight rotation of the nut relative to the screw. As these other relative motions between nut 56 and coupling 38 are possible, the combination of nut 56 and coupling 38 forms, in effect, a universal coupling. This permits the coupling and nut to take up the slack motion caused by inaccuracies in the fabrication and assembly of the work station and further to tolerate wear of the components without binding.

While the preferred embodiment is manually operated, it will be obvious to those skilled in the art that the adjustment may be powered, with, for instance, one or more electric motors rotating screws 46. Then, too, while pairs of screws 46 are preferably linked together by reciprocating rods 96 and 98, the coupling could equally well be accomplished by chain, belt, gearing, or the like. Further, while the preferred embodiment fixes screws 46 relative to the fixed posts and affixes couplings 38 to the movable posts, the relative positions may be reversed, the screws, for instance, being fixed relative to and traveling with the movable posts. It will also be recognized that head 40 of coupling 38 may be rounded, rather than flat, and belled, rather than flanged.

Then, too, while the preferred embodiment makes use of a pin engaging a waisted nut as near the axis of rotation of the nut as is structurally feasible, in order to minimize any couple of forces about axes normal to the axis of rotation, it will be apparent that other configuations of nut and coupling may also accomplish the same end. Thus, rather than a single pin and a planar kerf, multiple pins and multiple grooves could be used. Indeed, it will be appreciated that in situations where space permits, a nut with a circumferential groove and a coupling in the form of a spanner engaging the groove at a pair of diametrically opposite points may even further reduce the couple about one axis of rotation.

Clearly, also, the present invention is applicable to use with differing numbers of posts and to provide motion in any direction.

Since these and other changes may be made in the above apparatus without departing from the scope of the invention herein involved, it is intended that all matter contained in the above description or shown in the accompanying drawings shall be interpreted in an illustrative and not in a limiting sense.

What is claimed is:

1. In an adjustable height table comprising a pair of telescoping table support and elevating assemblies each including a first stationary post and a second movable post, means securing said stationary posts in fixed spatial relation to each other, a table top secured to said movable posts so as to move therewith relative to said stationary posts, and a pair of synchronized post drive means for causing said movable posts to telescope up or down relative to said stationary posts, said post drive means each comprising a screw, means mounting said screw for rotation about its own axis, an elevating nut mounted on said screw so as to permit relative rotation between it and the screw, means holding said elevating nut against rotation as said screw is rotated, and a support pin connecting said elevating nut to the movable post of an adjacent one of said table support and elevating assemblies so as to cause said movable post to be telescoped relative to the stationary post of said adjacent table support and elevating the assembly as said screw is rotated, the improvement wherein each of said nuts has a kerf located to one side and extending transversely of its center axis, said kerf being defined by a pair of parallel flat side surfaces and a flat bottom surface extending between said flat side surfaces, and further wherein each of said support pins has one end connected to one of said movable posts and an opposite end that extends into the kerf of one of said nuts and is movable in said kerf parallel to side surfaces, whereby said elevating nuts and said support pins are coupled so as to (a) cause said movable posts to move with said elevating nuts as said screws are turned and (b) allow said pins to shift in said kerfs relative to said elevating nuts as said screws are turned so as to accommodate and compensate for misalignment of said screws.

2. Apparatus according to claim 1 wherein said stationary and movable posts are tubular and said pins are inserted in holes in said movable posts.

3. Apparatus according to claim 2 wherein said stationary and movable posts have polygonal cross-sections and each pin is mounted in a pair of diametrically opposed holes in one of said movable posts.

4. Apparatus according to claim 3 wherein each pin has a radially-extending shoulder limiting the extent to which said pin may be inserted in the said holes of a movable post.

5. Apparatus according to claim 1 wherein each of said nuts has a polygonal configuration characterized by a plurality of flat side surfaces, and said flat bottom surface extends parallel to one of the side surfaces of said nut.

6. Apparatus according to claim 5 wherein each nut has upper and lower surfaces and the kerf in said each nut extends between and parallel to said upper and lower surfaces.

7. Apparatus according to claim 1 wherein said opposite end of each pin has an enlarged head to facilitate pivoting of said pin in the said kerf of the nut to which said each pin is coupled.

8. Apparatus according to claim 3 wherein each of said stationary and movable posts is rectangular in cross-section and said stationary posts have longitudinally extending slots having a width greater than the diameter of said pins, and further wherein said pins extend through said slots between said nuts and said movable posts.

9. Apparatus according to claim 8 wherein said kerfs are sized so as to limit movement of said pins relative to said nuts in a direction parallel to said screws.

10. In an adjustable height table comprising a pair of telescoping table support assemblies each including a first stationary post and a second movable post, means securing said stationary posts in fixed spatial relation to each other, a table top secured to said movable posts so as to move therewith relative to said stationary posts, and a pair of synchronized post drive means for causing said movable posts to telescope up or down relative to said stationary posts;

the improvement wherein each of said post drive means comprises a screw, means mounting said screw for rotation about its own axis, a nut mounted on said screw so as to permit relative rotation between it and said screw, a slot in said nut located to one side of and extending transversely of its center axis, and a support pin having one end slidably disposed in said slot and an opposite end connected to the movable post of an adjacent one of said table support assemblies, said slot being sized so as to prevent relative movement of said pin and nut in a direction parallel to said axis while permitting relative movement of said pin and nut in a direction at a right angle to said axis, whereby as said screws are turned (a) said movable posts move with said nuts lengthwise of said screws and (b) said pins are free to shift in said slots so as to accommodate and compensate for misalignment of said screws.

* * * * *